US009446442B2

(12) United States Patent
Reiter et al.

(10) Patent No.: US 9,446,442 B2
(45) Date of Patent: Sep. 20, 2016

(54) MOVING WORKPIECE PARTS ON MACHINE TOOLS

(71) Applicant: TRUMPF Werkzeugmaschinen GmbH + Co. KG, Ditzingen (DE)

(72) Inventors: Tobias Reiter, Bietigheim-Bissingen (DE); Wolfgang Laib, Besigheim (DE); Stefan Buettner, Markgroeningen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 0 days.

(21) Appl. No.: 14/932,074

(22) Filed: Nov. 4, 2015

(65) Prior Publication Data

US 2016/0052040 A1 Feb. 25, 2016

Related U.S. Application Data

(62) Division of application No. 13/903,204, filed on May 28, 2013, now Pat. No. 9,205,481.

(30) Foreign Application Priority Data

May 30, 2012 (EP) ..... 12169979

(51) Int. Cl.
*B21D 45/00* (2006.01)
*B21D 45/08* (2006.01)
(Continued)

(52) U.S. Cl.
CPC ..... *B21D 45/006* (2013.01); *B21D 28/265* (2013.01); *B21D 45/08* (2013.01); *B21D 45/10* (2013.01); *Y10T 83/0448* (2015.04); *Y10T 83/2137* (2015.04)

(58) Field of Classification Search
CPC .... B21D 45/08; B21D 45/10; B21D 45/006; B21D 28/265; B21D 28/26; Y10T 83/0448; Y10T 83/2137; Y10T 83/8828; Y10T 83/8858; Y10T 83/822; B23D 31/00; B23D 15/14; B23D 36/0091; B26D 9/00
USPC ..... 83/23, 130, 618, 76.1, 62.1, 554, 76.7, 83/639.2, 39, 49, 76.6, 72, 639.3, 639.4, 83/543, 544, 586, 140, 76.8, 76.9; 234/35, 234/120
See application file for complete search history.

(56) References Cited

U.S. PATENT DOCUMENTS 4,466,317 A * 8/1984 Ikeda ..... B21D 45/003 192/129 A (Continued)

FOREIGN PATENT DOCUMENTS

CN 101035637 A 9/2007
CN 102016329 A 4/2011

(Continued)

*Primary Examiner* — Ghassem Alie
(74) *Attorney, Agent, or Firm* — Fish & Richardson P.C.

(57) ABSTRACT

Machine tools for processing plate-like workpieces by punching include a punching tool including a punch and a punching die, a drive unit for moving the punch and the punching die relative to each other along a stroke axis for cutting a workpiece part free from a plate-like workpiece, a hold-down device that is movable along the stroke axis and that includes a stripper that contacts an upper surface of the plate-like workpiece while the plate-like workpiece is punched through by the punch, a detection device for detecting a reference position of the hold-down device along the stroke axis, wherein the stripper contacts the upper surface of the workpiece at the reference position, and a numerical control unit for positioning the stripper at a particular distance from the reference position such that a workpiece part that has been cut off can be moved away from a processing region.

7 Claims, 4 Drawing Sheets

(51) Int. Cl.
*B21D 28/26* (2006.01)
*B21D 45/10* (2006.01)

(56) References Cited

U.S. PATENT DOCUMENTS

| | | | |
|---|---|---|---|
| 5,136,521 | A | 8/1992 | van Daalen et al. |
| 7,427,258 | B2 | 9/2008 | Schmauder |
| 2003/0070516 | A1 | 4/2003 | Harada |
| 2011/0011232 | A1 | 1/2011 | Barandiaran Echeguia |

FOREIGN PATENT DOCUMENTS

| | | | |
|---|---|---|---|
| EP | 0417836 | A1 | 3/1991 |
| EP | 0243407 | B1 | 7/1991 |
| EP | 1281455 | B1 | 6/2007 |
| EP | 2184118 | A1 | 5/2010 |
| JP | 61172632 | A | 8/1986 |
| JP | 10286636 | A | 10/1998 |
| JP | 2001047148 | A | 2/2001 |
| WO | WO9721503 | A1 | 6/1997 |
| WO | WO2009062650 | A2 | 5/2009 |

* cited by examiner

MOVING WORKPIECE PARTS ON MACHINE TOOLS

CROSS REFERENCE TO RELATED APPLICATION

This application is a divisional application which claims priority to U.S. application Ser. No. 13/903,204, filed May 28, 2013, which claims priority under 35 U.S.C. §119 to EP application serial number 12 169 979.7 filed on May 30, 2012. The contents of these priority applications are hereby incorporated by reference in their entirety.

TECHNICAL FIELD

This disclosure relates to machine tools and related methods for moving a workpiece part away from a processing region of a machine tool.

BACKGROUND

Upon cutting a workpiece part free from a workpiece during processing of the workpiece (e.g., punching the workpiece), the workpiece part often times needs to be removed from the processing region of a machine tool used to process the workpiece or from a support plane that supports the workpiece. Accordingly, the workpiece part may be moved along the support plane on a workpiece table, for example, so that the workpiece part can be tipped over the edge of the workpiece table. In some examples, the workpiece part may be positioned over a parts chute that extends from the workpiece table so that the workpiece part can be discharged through the parts chute.

In some examples, a machine tool includes a hold-down device for holding the workpiece down against the support plane as the workpiece is being punched through. A stripper (e.g., a plate-shaped stripper) may be mounted to an end of the hold-down device. During the punching stroke (e.g., as the punch or a punching cutter punches through the workpiece), the stripper rests on an upper surface of the workpiece in order to hold the workpiece down against the workpiece support during the punching operation.

The hold-down device and/or the stripper can be used to discharge a workpiece part. In some examples, a punching tool includes a stepped hold-down device including an underside with first and second surfaces that do not lie in a common plane. The first surface clamps a portion severed from a remaining sheet, while the remaining sheet is unrestrained adjacent the second surface. To remove the severed sheet portion from the punching machine, the unrestrained remaining sheet can be displaced while the severed, clamped sheet portion is held securely or moved independently of the remaining sheet.

Alternatively, a workpiece part can also be discharged by moving the remaining workpiece along the support plane while the workpiece part that has been cut free is driven along the support plane and thereby pushed away from the processing region by the remaining workpiece.

SUMMARY

The present disclosure relates to machine tools and methods for increasing a process reliability of moving workpiece parts away from processing regions of machine tools.

According to one aspect of the invention, a machine tool for processing plate-like workpieces by punching includes a punching tool including a punch and a punching die, a drive unit for moving the punch and the punching die relative to each other along a stroke axis for cutting a workpiece part free from a plate-like workpiece, a hold-down device that is movable along the stroke axis and that includes a stripper that rests on an upper surface of the plate-like workpiece while the plate-like workpiece is punched through by the punch, a detection device for detecting a reference position of the hold-down device along the stroke axis, wherein the stripper rests on the upper surface of the workpiece at the reference position, and a numerical control unit for positioning the stripper at a particular distance from the reference position such that a workpiece part that has been cut off from the workpiece during the punching process can be moved away from a processing region of the machine tool. To position the stripper at a desired distance above the workpiece, the method includes determining the position of the stripper or hold-down device at which the stripper contacts the upper surface of the workpiece and, starting from that position, selecting the distance, which is typically not greater than the thickness of the plate-like workpiece, so that the stripper is able to act as a guide and, at the same time, the workpiece part that has been cut free is prevented from being pushed over the remaining workpiece and becoming jammed between the stripper and the remaining workpiece.

In some embodiments, the machine tool includes a driver arrangement for coupling motion between the hold-down device and the punch while the stripper is lifted from the upper surface of the workpiece. Due to the motion coupling, the position of the hold-down device relative to the punch remains constant while the stripper is lifted from the upper surface of the workpiece and during a subsequent portion of the punching stroke. In this manner, the numerical control unit for positioning the stripper at the particular distance from the workpiece uses the drive unit of the punch for positioning the stripper at the particular distance from the upper surface of the workpiece. In certain embodiments, for example, where the hold-down device has its own drive unit (e.g., its own hydraulic drive unit), the numerical control unit for positioning the stripper can actuate the drive unit of the hold-down device.

In some embodiments, the numerical control unit is configured to recognize that motion coupling has begun by comparing the positions of the hold-down device and the punch along the stroke axis. Such motion coupling or synchronous movement of the punch and the hold-down device typically occurs only upon lifting the hold-down device from the upper surface of the workpiece. More specifically, the position of the hold-down device and/or stripper does not change when the workpiece is being punched through, whereas the position of the punch along the stroke axis does vary while the workpiece is being punched through. Accordingly, synchronous movement of the punch and the hold-down device only occurs during lifting of the hold-down device after withdrawal of the punch or punch cutter from the workpiece. Once the synchronous upward movement of the hold-down device and the punch begins, the punch (and accordingly, the hold-down device) may be stopped after traveling a particular distance above the upper surface of the workpiece (i.e., thereby forming a push-out position).

In certain embodiments, the detection device includes a measurement device for determining the position of the hold-down device along the stroke axis. The measurement device may be a displacement measurement device that includes an optical sensor for detecting the position of the hold-down device along the stroke axis. For displacement measurement, a scale may be provided on the hold-down device. In some examples, the scale includes equidistant position marks that can be sensed by the optical sensor. In some embodiments, a machine tool may include displacement measurement devices that operate based on other measurement principles (e.g., the principle of magnetostriction). In such an embodiment, a waveguide made of a ferromagnetic material is typically used as the measurement element, and a movable permanent magnet serves as a position indicator (e.g., as described in detail in an article entitled "Magnetostriktion" available at www.mtssensors.de).

In some examples, it is not imperative to determine the absolute position of the hold-down device relative to the fixed frame of the machine tool. Rather, it may be sufficient to recognize whether synchronous movement of the hold-down device and the punch or of a ram acting thereon is occurring, or whether the hold-down device and the punch are being moved independently of each other. A suitable measurement device for determining the displacement or position of the punch along the stroke axis is typically associated with the punch.

In certain embodiments, the hold-down device is connected to the punch via a pre-tensioning device, which, when in a resting position, positions a lower edge of the punch in a flush alignment with a lower edge of the stripper. In such a case, the hold-down device is typically spring-mounted on the punch such that the hold-down device and the punch are moved synchronously and in a motion-coupled manner along the stroke axis provided that the pre-tensioning device (e.g., a spring) remains at the resting position. Movement of the pre-tensioning device out of its resting position typically takes place if the underside of the stripper rests on the upper side of the workpiece during the punching stroke, since the workpiece forms an abutment, thereby causing the force exerted on the punch or the pre-tensioning device to increase and the pre-tensioning device to be compressed.

In some embodiments, the detection device is configured to detect the reference position of the hold-down device via a force exerted by the punch on a drive unit of the punching tool when the punch contacts the upper surface of the workpiece. The punching force increases once the punch reaches the upper surface of the workpiece. Accordingly, the increased force exerted on the drive unit (e.g. the ram) can be detected, for example, as described in EP1281455B1, which is herein incorporated by reference in its entirety. Since the lower edge of the stripper and the lower edge of the punch are flush, the position at which the lower edge of the punch contacts the upper side of the workpiece corresponds to the reference position of the stripper.

In certain embodiments, the control device is configured to specify the distance of the stripper from the upper surface of the workpiece based on a thickness of the workpiece to be processed. For reliable movement of the workpiece part away from the processing region, the distance of the stripper from the upper surface of the workpiece should be sufficiently small in order to prevent the workpiece part that is being pushed away from jamming between the remaining workpiece and the stripper. The numerical control unit may obtain the thickness of the processed workpiece from a storage device. In alternative embodiments, the thickness of the workpiece can be measured as a punching stroke is being performed, for example, as described in EP1281455B1, which is incorporated herein in its entirety by reference. A positioning of the stripper at a distance of half of the thickness of the workpiece has been found particularly advantageous for pushing workpiece parts away from the processing region. While the stripper may also be positioned at a different distance (e.g., a distance dependent on the workpiece thickness), selecting a distance greater than the thickness of the workpiece should generally be avoided. In some examples, the distance is between about 0*d and about 1.0*d. In some examples, the distance may also be specified independently of the thickness of the workpiece, for example, when the distance is so small (e.g. about equal to or less than 0.2 mm) that it is smaller than the workpiece thickness irrespective of the type of workpiece to be processed.

In some embodiments, the machine tool additionally includes a movement device for moving the workpiece part that has been cut free away from the processing region, by moving the workpiece part together with the workpiece along a support plane. In certain embodiments, a device that serves to move the workpiece along the support plane and that is provided on the machine tool can be used as a movement device. For example, the movement device may be a coordinate guide including a linear drive with which the tool, clamped in a collet chuck, may be moved or displaced over the support plane of a workpiece table.

In some embodiments, the detection device for detecting the reference position has a sensor mounted on the stripper. In some embodiments, the sensor is an optical sensor, which, when the stripper contacts the workpiece, is covered by the workpiece and therefore detects no radiation. When the stripper contacts the workpiece or is lifted off of the workpiece, then the radiation output detected by the optical sensor distinctly changes, so that the reference position of the stripper can be detected. Typically, the stripper is an electrically conductive component (e.g., a metal), and the workpiece (e.g., a metal sheet) is also an electrically conductive component. Therefore, the reference position may also be determined by a resistance measurement or a voltage measurement since lifting the stripper from the workpiece interrupts the electrical contact between the two components.

In another aspect of the invention, a method of moving a workpiece part away from a processing region of a machine tool for processing plate-like workpieces by punching includes moving a punch and a punching die relative to each other along a stroke axis for cutting the workpiece part free from a workpiece, wherein, while the workpiece is being punched through with the punch, a stripper mounted on a hold-down device of the machine tool rests on an upper surface of the workpiece, determining a reference position of the hold-down device along the stroke axis, at which the stripper contacts the upper surface of the workpiece, positioning the stripper at a particular distance from the reference position, and moving the workpiece part that has been cut free away from the processing region of the machine tool.

The workpiece part that has been cut free is typically pushed away from the processing region by the remaining workpiece along a support plane. Accordingly, the workpiece part may be moved to a discharge position of the machine tool. Example discharge positions include a location of a parts chute, an edge of the workpiece support or, a location of a parts slide. From the discharge position, the workpiece part can be transported away from the machine tool manually or by using suitable transport devices.

In some embodiments, the distance between the stripper and the upper surface of the workpiece depends on a thickness of the workpiece. The distance between the lower edge of the stripper and the upper surface of the workpiece should not be greater than the thickness of the workpiece.

In some embodiments, selecting the distance as at least half of the thickness of the workpiece ensures (e.g., especially in the case of thin workpieces having a thickness of less than 1 mm) that the workpiece part does not become jammed between the stripper and the die when being pushed away from the processing region. In certain embodiments, the distance may be selected as at least one quarter or at least one third of the thickness of the workpiece. In general, the distance should be greater than zero in order to prevent jamming.

In some embodiments, the hold-down device and the punch are motion-coupled during lifting of the stripper from the upper surface of the workpiece. When punching through the workpiece, the punch is moved along the stroke axis relative to the stripper, which rests on the workpiece in a fixed location. Upon lifting the stripper off of the workpiece, (i.e., after the punch or punching cutter has been withdrawn out of the workpiece), the hold-down device and the punch are motion-coupled via a driving arrangement (e.g., a mechanical driving arrangement).

In certain embodiments, detection that the motion coupling has begun occurs via a comparison of the positions of the hold-down device and the punch along the stroke axis. When the coupled motion begins, the positions of the hold-down device and the punch change synchronously (i.e., the spacing between the two positions remains constant) and can be detected by a suitable position measurement or displacement measurement device for the hold-down device and the punch.

In some embodiments, the hold-down device is connected to the punch via a pre-tensioning device that positions a lower edge of the punch in a flush alignment with a lower edge of the stripper when the pre-tensioning device is in a resting position. The reference position of the hold-down device is detected via a force exerted on a drive unit of the punching tool upon the punch contacting the upper side of the workpiece. Upon contact between the punch or stripper and the workpiece, the pre-tensioning device is displaced. As a result of such displacement, the force exerted on the drive unit or ram increases, thereby allowing the position at which the stripper and the lower edge of the punch rest on the upper surface of the workpiece to be detected. The desired distance can be set after the workpiece has been punched through, by moving the punch upwards from the reference position by a suitable value (e.g., half of the thickness of the metal sheet) so that the workpiece part can be reliably pushed away from the processing region.

A number of embodiments have been described. Nevertheless, it will be understood that various modifications may be made without departing from the spirit and scope of the disclosure. For example, the features described above and the features set forth hereinafter may also be used individually or in any desired combination. The embodiments shown and described are not to be understood as forming a definitive list, but rather are of the nature of examples for illustrating the invention. Further advantages will be apparent from the description, the drawings, and the claims.

DETAILED DESCRIPTION

Figure 1:
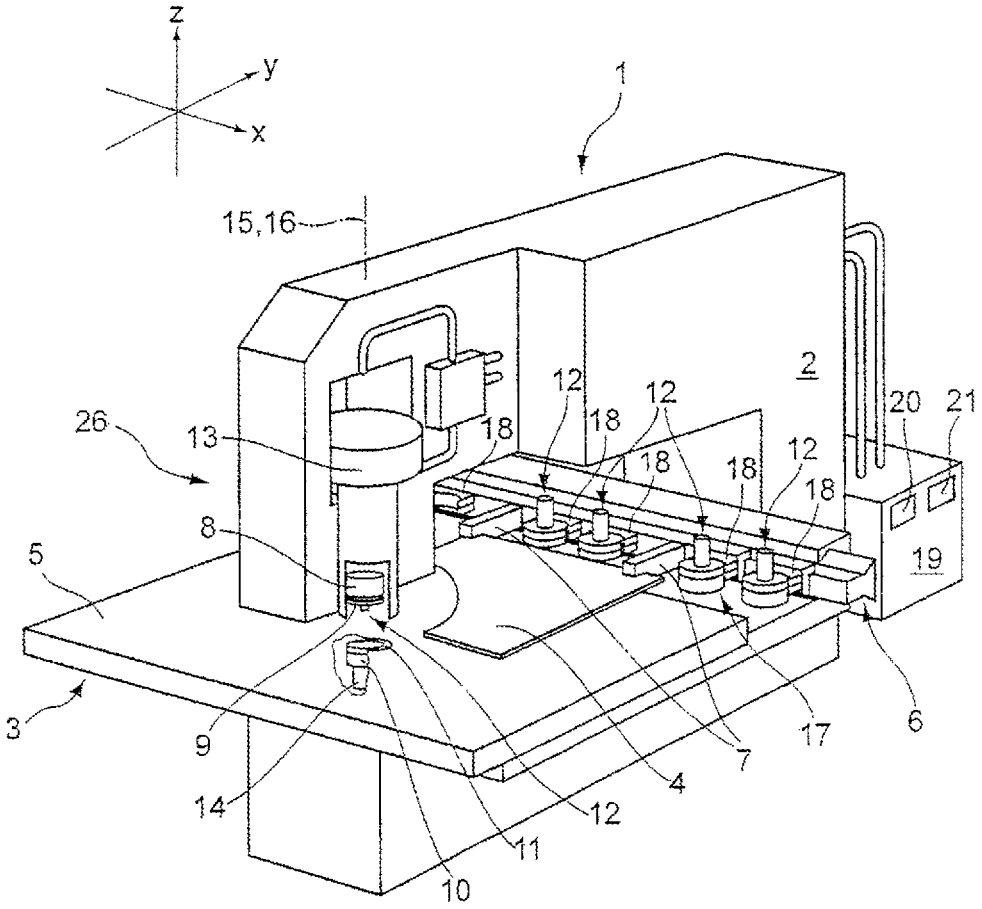
FIG. 1 illustrates a punching/forming machine.

FIG. 1 shows a punching/forming machine 1 for cutting and/or forming plate-like workpieces during the processing of metal sheets. The punching/forming machine 1 includes a machine frame 2 (e.g., a C-shaped machine frame) and a workpiece table 3 that is positioned within a throat of the machine frame 2. The workpiece table 3 is configured to support a workpiece 4 (e.g., a metal sheet) that is to be processed. On its upper surface, the workpiece table 3 forms a horizontal support plane 5 for the metal sheet 4 to be processed. The support plane 5 extends parallel to the x/y plane of the coordinate system shown in FIG. 1. The punching/forming machine 1 further includes a coordinate guide 6 that is operable to displace the workpiece 4 along the support plane 5 via clamps 7 that hold the metal sheet 4 in a fixed position with respect to the coordinate guide 6.

The punching/forming machine 1 further includes a punch holder 8 and a punch 9 that is supported by the punch holder 8. The punch holder 8 and the punch 9 are located near a front end of the upper arm of the machine frame 2. The punching/forming machine 1 further includes a die holder 10 and a punching die 11 that is supported by the die holder 10. The die holder 10 and the punching die 11 are located near a front end of the lower arm of the machine frame 2. The punch 9 and the punching die 11 together form a tool 12 for processing (e.g., severing) the metal sheet 4.

The punching/forming machine 1 includes a punch drive 13 and a die drive 14 (e.g., linear drives) that form a drive unit. The punch drive 13 is operable to raise and lower the punch holder 8 (and accordingly, the punch 9 supported thereon and secured thereto) relative to the workpiece table 3 along a stroke axis 15. Similarly, the die drive 14 is operable to raise and lower the die holder 10 (and accordingly, the punching die 11 supported therein and secured thereto) relative to the workpiece table 3 along the stroke axis 15. In addition, a rotatory drive (not shown in detail) is operable to adjust a rotational position of the punch holder 8 and a rotational position of the die holder 10 independently of each other about a tool rotation axis 16, which is identical to the stroke axis 15.

Still referring to FIG. 1, the punching/forming machine 1 further includes a linear magazine 17 that is supported by the coordinate guide 6. The linear magazine 17 supports one or more tools 12, which are each held by a respective tool cassette 18. Each tool 12 can be secured to the punch holder 8 and to the die holder 10 as required for processing the metal sheet 4. Thus, the tools 12 are stored in the linear magazine until the tools 12 are needed for forming the workpiece 4.

During tool changing and workpiece processing operations, the drives 13, 14 of the punching/forming machine 1 are controlled by a numerical control unit 19. The numerical control unit 19 includes a storage 20 for storing tool data and a control device 21. The control device 21 is operable to calculate and control the raising, lowering, and rotational movements of the punch holder 8 and the die holder 10 based on the stored data related to the workpiece 4 and to the particular tool 12 being used during the processing operation.

FIGS. 2*a*-2*d* illustrate a method of performing a punching stroke using the punching tool 12 (the punching die 11 of the punching tool 12 is not shown since the die 11 remains in a fixed location during the punching operation, as will be described in more detail below). A lower end of the punch 9 extends through a passage (e.g., a cylindrical passage) of a hold-down device 24 and towards the workpiece 4. The punch 9 is moved along the stroke axis 15 by the punch drive 13 (shown in FIG. 1). Such movement of the punch 9 by the punch drive 13 may be effected, for example, by a piston (not shown) or by media pressure (e.g. pneumatics, hydraulics, etc.). During downward movement of the punch 9 along the stroke axis 15, the hold-down device 24 contacts an upper (e.g., driver) surface (not shown) of the punch 9 such that the movement of the punch 9 determines the speed and position of the hold-down device 24. A stripper 25 (e.g., a plate-shaped stripper) is mounted to a lower end of the hold-down device 24 that faces the workpiece 4. The stripper 25 defines an aperture that is sized to allow passage of a punching cutter 9*a* of the punch 9 for processing the workpiece 4.

Figure 2A:
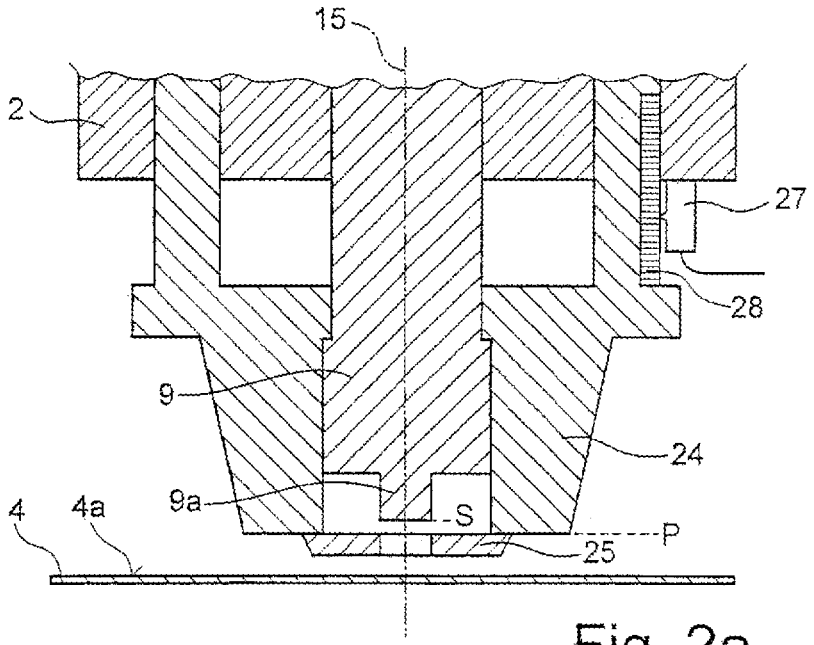
FIGS. 2*a*-2*d* illustrate a method of performing a punching stroke with a punch, a hold-down device, and a stripper.

Referring particularly to FIG. 2*a*, the punching cutter 9*a* of the punch 9 is withdrawn inside of the passage of the hold-down device 24. As referred to hereinafter, the lower end surface of the punching cutter 9*a* will define a position S along the stroke axis 15, and the lower end surface of the hold-down device 24 to which the stripper 25 is secured will define a position P along the stroke axis 15.

Figure 2B:
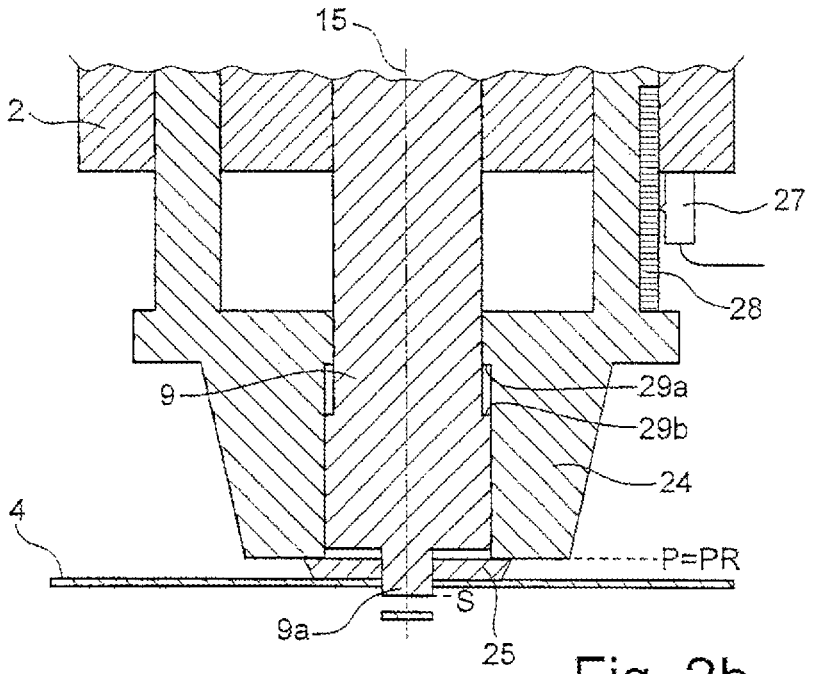

Referring particularly to FIG. 2*b*, as the workpiece 4 is punched through, a lower surface of the stripper 25 contacts the upper surface 4*a* of the workpiece 4. As referred to hereinafter, the position of the hold-down device 24 shown in FIG. 2*b* (i.e., the position of the hold-down device 24 while the lower surface of the stripper 25 contacts the upper surface 4*a* of the workpiece 4) will define a reference position PR of the hold-down device 24. The punch 9 is moved down beneath the position of the stripper 25 such that the punching cutter 9*a* passes through the aperture in the stripper 25 to process the workpiece 4 by punching. A resulting punched out piece of the workpiece is formed and discharged downwardly through the die 11 (not shown). As the workpiece 4 is punched through, the hold-down device 24 remains in a fixed location while the punch 9 changes its position S along the stroke axis 15. Such a change of the position S of the punch 9 relative to the position P of the hold-down device 24 is illustrated by the region formed between a shoulder 29*b* (e.g., a radial shoulder) of the punch 9 and a shoulder 29*a* (e.g., a radial shoulder) of the hold-down device 24.

Figure 2C:
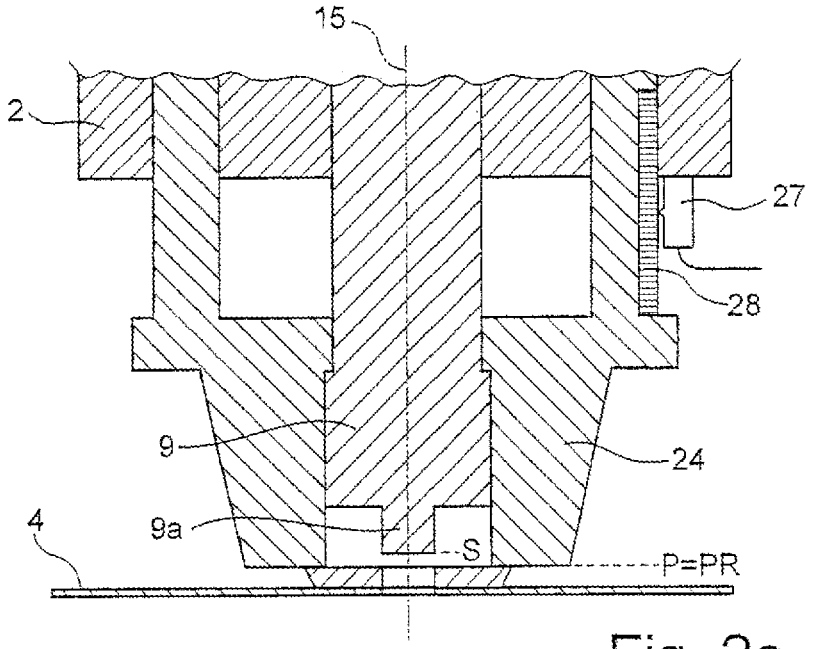

Referring particularly to FIG. 2*c*, the punch 9 has been withdrawn inside of the passage of the hold-down device 24 such that the shoulders 29*a* and 29*b* (shown in FIG. 2*b*) rest against each other while the hold-down device 24 is positioned at the reference position PR. The position P of the hold-down device 24 is sensed by a displacement measurement device that forms a part of a detection device 26 (shown in FIG. 1). The displacement measurement device includes a scale 28 (e.g., a linear scale) that is provided on the hold-down device 24 and an optical sensor 27 that is provided at a fixed location on the machine frame 2. In some embodiments, the displacement measurement device may be configured differently than shown in FIGS. 2*a*-2*d*. For example, the sensor 27 may be provided on the hold-down device 24, and the scale 28 may be provided on the machine frame 2. In some embodiments, a mechanical sensor may be provided for sensing the position P of the hold-down device 24 instead of or in addition to the optical sensor 27. In some embodiments, a displacement measurement device that operates based on the principle of magnetostriction may be used to sense the position P of the hold-down device 24.

The detection device 26 (shown in FIG. 1) communicates with the displacement measurement device of the hold-down device 24 and with another displacement measurement device (not shown) for sensing the position S of the punch 9 along the stroke axis 15. The detection device 26 further communicates with the numerical control unit 19. The numerical control unit 19 compares the position P of the hold-down device 24 to the position S of the punch 9. Using the compared positions, it is possible to determine whether the stripper 25 remains in contact with the upper surface 4*a* of the workpiece 4 (i.e., where the position S of the punch 9 has changed, but the position P of the hold-down device 24 remains unchanged). If the stripper 25 is lifted from the upper surface 4*a* of the workpiece 4, the shoulder 29*a* of the hold-down device 24 and the shoulder 29*b* of the punch 9 move simultaneously, forming a driver arrangement that couples the motion of the hold-down device 24 to the motion of the punch 9. The simultaneous movement is detected by the numerical control unit 19. Once the stripper 25 is lifted from the upper surface 4*a* of the workpiece 4, the difference ΔPS (shown in FIG. 2*d*) between the position P of the hold-down device 24 and the position S of the punch 9 remains constant.

Figure 2D:
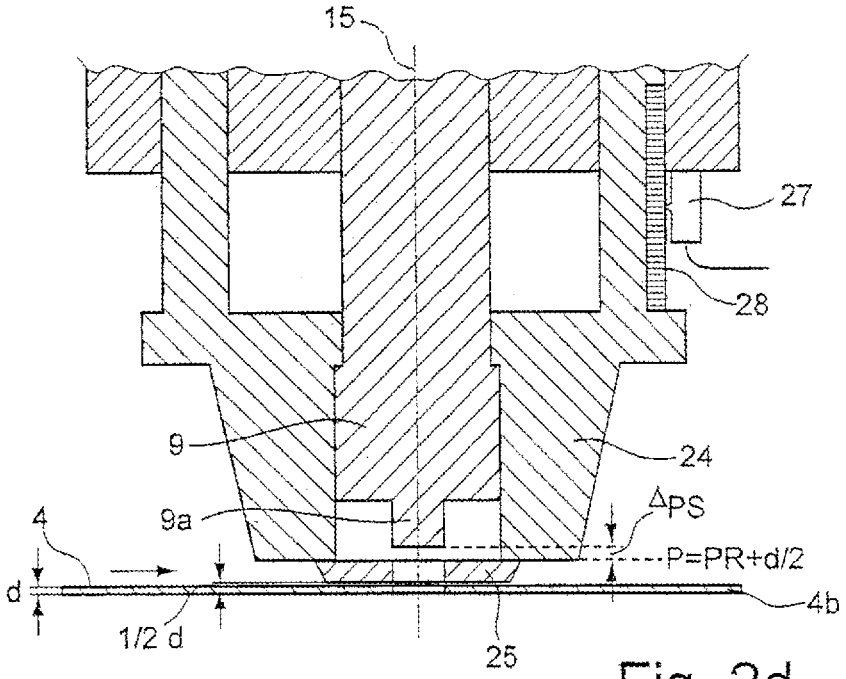

Referring particularly to FIG. 2*d*, the numerical control unit 19 stops the punch 9 once the punch 9 has traveled a distance along the stroke axis that is equal to about half of the thickness d/2 of the workpiece 4 of thickness d. Since the hold-down device 24 (and, hence, the stripper 25) is carried along with the punch 9 during the upward movement, the stripper 25 is also stopped or fixed in a position that is equal to about half of the thickness d/2 of the workpiece 4 (i.e., a gap having a width of about d/2 is formed between the upper surface 4*a* of the workpiece 4 and the stripper 25).

In the position shown in FIG. 2*d*, the stripper 25 has reached a push out position in which a workpiece part 4*b* (shown to the right of the stroke axis 15) that has been cut off from the workpiece 4 during the punching process can be moved to a discharge position (e.g., a position near an edge of the workpiece table 3). In this configuration, a remaining portion of the clamped workpiece 4 is displaced via the coordinate guide 6 along the support plane 5 of the workpiece table 3 (e.g., in the direction of the horizontal arrow shown in FIG. 2*d*). During this movement, the workpiece part 4*b* that has been cut free is moved (e.g., pushed) away from the processing region of the punching/forming machine 1 by the remaining portion of the workpiece 4. The stripper 25 is lifted from the upper surface 4*a* of the workpiece 4 during this operation, thereby preventing the workpiece 4 and the workpiece part 4*b* from becoming jammed between the stripper 25 and the workpiece table 3. Since the gap formed between the stripper 25 and the workpiece 4 is smaller than the thickness d of the workpiece 4, upon being pushed, the workpiece 4 cannot be pushed over the workpiece part 4*b* and thus become jammed or prevent the push-out operation.

The position of the stripper 25 and the distance between the upper surface 4*a* of the workpiece 4 and the stripper 25 is selected based on the thickness d of the workpiece 4. The distance should not be greater than the thickness d of the workpiece 4. In some embodiments, the thickness d of the workpiece 4 is stored in the numerical control unit 19 or in the storage 20. In some embodiments, the thickness d of the workpiece 4 is determined during processing of the workpiece 4. Although the distance is selected as half the thickness d/2 of the workpiece 4 in the example of FIG. 2*d*, in some examples, the distance may vary within a range of values. For example, the distance may range from about 0*d to about 1.0*d, (e.g., from about 0.01*d to about 1.0*d, or from about 0.1*d to about 1.0*d).

In some embodiments, a detector or a sensor device may be integrated with the stripper 25 to detect or aid in the detection of the reference position PR or the lifting of the stripper 25 from the upper surface 4*a* of the workpiece 4. In some embodiments, the detector or sensor may be an optical sensor. In some embodiments, the reference position PR or the lifting of the stripper 25 may be determined using a resistance measurement or a voltage measurement, since the lifting of the stripper 25 from the workpiece 4 interrupts the electrical contact between the two components.

Positioning the stripper 25 at a distance above the upper surface 4*a* of the workpiece 4 suitable for moving the workpiece part 4*b* away from the processing region can also be implemented for other embodiments of punching/forming tools. For example, FIGS. 3*a*-3*e* illustrate a method of performing a punching stroke using such a punching tool 12.

Figures 3A, 3B, 3C, 3D, 3E:
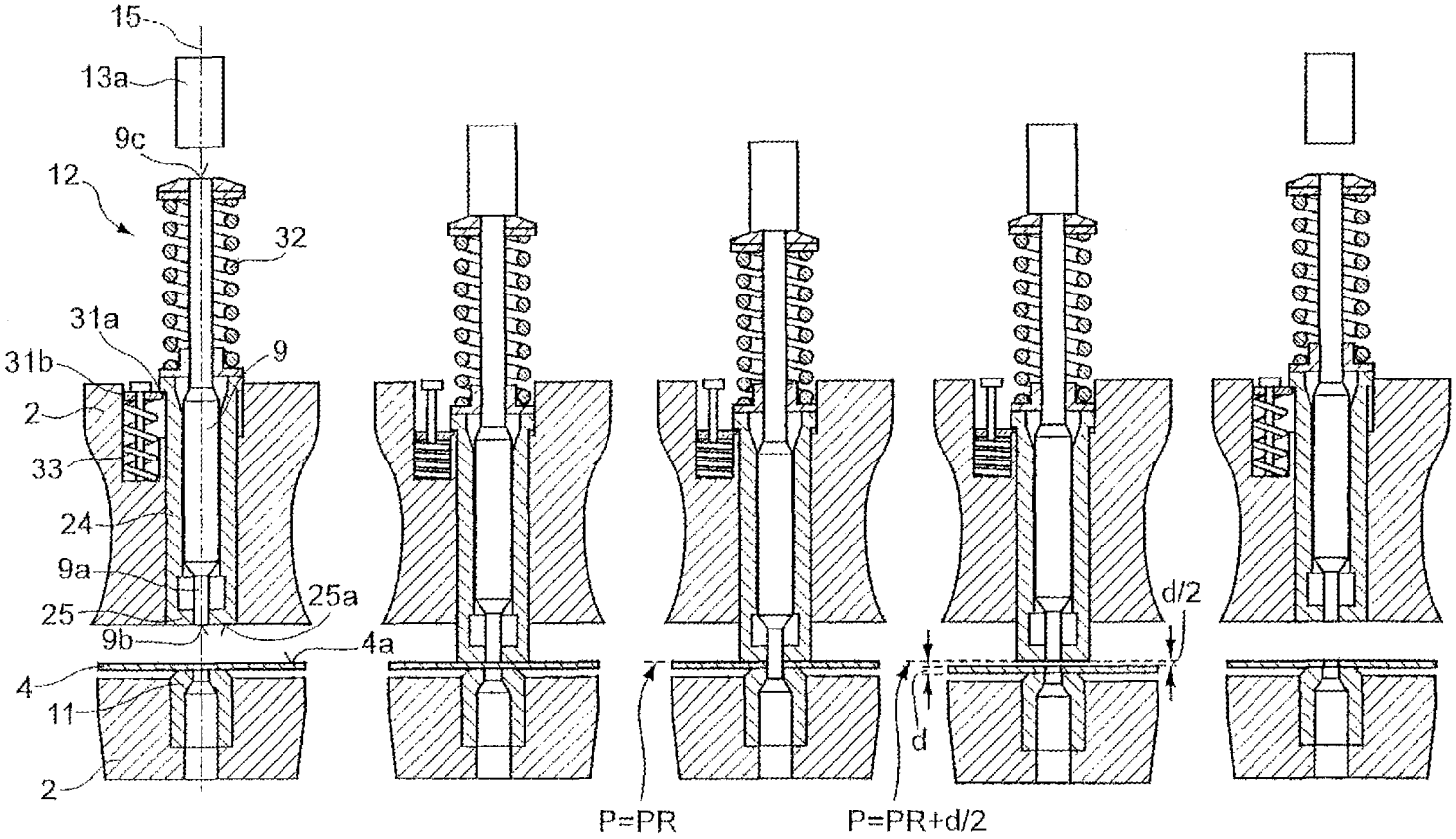
FIGS. 3*a*-3*e* illustrate a method of performing a punching stroke in which a hold-down device is connected to a punch via a spring.

Referring particularly to FIG. 3*a*, the punching tool 12 includes a punch 9, a hold-down device 24, and a spring 32 (e.g., a pre-tensioning device or a helical spring) that connects the punch 9 to the hold-down device 24, which together form a common assembly unit. The lower end of the punch 9 moves within a passage (e.g., a cylindrical passage) of the hold-down device 24. The spring 32 is mounted between a top plate of the punch 9 and a top end of the hold-down device 24. In a resting position of the spring 32 (i.e., when the spring 32 does not exert a force on the punch 9 or on the hold-down device 24 that is sufficient to move the punch 9 or the hold-down device 24), a lower edge 9*b* of the punch 9 and a lower surface 25*a* of a stripper 25 formed at the lower end of the hold-down device 24 are flush. In the example embodiment of FIG. 3*a*, the stripper 25 is integrally formed with the hold-down device 24. In some embodiments, the stripper 25 may not be integrally formed with the hold-down device 24, but may instead be mounted to the hold-down device 24 with a suitable fastening mechanism.

Still referring to FIG. 3*a*, a drive unit (e.g., a drive unit that is substantially similar in function to the drive unit 13 of FIG. 1) includes a ram 13*a* for performing a punching stroke. The ram 13*a* is positioned to contact and press down upon an upper surface 9*c* of the punch 9, thereby additionally effecting a downward movement of the hold-down device 24.

Referring particularly to FIG. 3*b*, the punch 9 is moved downwardly until the lower surface 25*a* of the stripper 25 and the lower side 9*b* of the punch 9 together contact the upper surface 4*a* of the workpiece 4. In this manner, the spring 32 remains in the resting position during such downward movement. During movement of the hold-down device 24, another spring 33 (e.g., a helical spring) supported by a machine frame 2 is compressed by a shoulder 31*a* (e.g., a radial shoulder) of the hold-down device 24. In this manner, the shoulder 31*a* of the hold-down device 24 acts on a driver plate 31*b* of the spring 33.

Referring particularly to FIG. 3*c*, further downward movement of the ram 13*a* compresses the spring 32 since the workpiece 4 forms an abutment for the hold-down device 24 and the punch 9. As a result, the punch 9, guided within the passage of the hold-down device 24, moves down further in order to punch a hole in the workpiece 4. As a result of the punch 9 contacting the workpiece 4 or as a result of the compression of the spring 32, the force exerted on the drive unit by the ram 13*a* increases. That increase in force can be detected, for example in the manner described in EP1281455B1, and positioning of the hold-down device 24 at a reference position PR can be detected by the numerical control unit 19 or a suitable detection device such as the detection device 26 shown in FIG. 1.

Referring particularly to FIG. 3*d*, after the ram 13*a* reaches a bottom-most point during the stroke movement, the ram 13*a* moves upward again, and the punch 9 is lifted up from the workpiece 4 by the spring 32 (i.e., the punch 9, driven by the action of the spring force, follows the upward movement of the ram 13*a*).

Once the spring 32 reaches the resting position, the hold-down device 24 and the punch 9 are moved upward by the action of the spring force of the spring 33 until the punch 9 again reaches the starting position shown in FIG. 3*a*. Another punching stroke can subsequently be performed.

In order to push a workpiece part away from the processing region during the upward movement, the punch 9 and the ram 13*a* may be fixed in a position in which the stripper 25 is positioned at a distance of half of the thickness d/2 of the workpiece thickness d from the upper surface 4*a* of the workpiece 4. Accordingly, the numerical control unit 19, which knows the position of the ram 13*a* along the stroke axis 15 from data provided by a distance measurement device (not shown), makes reference to the position PR of the hold-down device 24. The position PR was determined at the configuration shown in FIG. 3*b*, thereby allowing the numerical control unit 19 to position the ram 13*a* at an appropriate position. Moving (e.g., pushing) the workpiece part 4*b* that has been cut free from the workpiece 4 away from a processing region can be carried out with the stripper 25 positioned as shown in FIG. 3*d* in the manner as described in with respect to FIGS. 2*a*-2*d*.

Thus, positioning the stripper 25 at a particular distance (e.g., based on the thickness d of the workpiece 4) along the stroke axis 15 from the upper surface 4*a* of the workpiece 4 while a workpiece part 4*b* is moved away from the processing region can significantly increase the reliability of such a process.

A number of embodiments have been described. Nevertheless, it will be understood that various modifications may be made without departing from the spirit and scope of the disclosure. Accordingly, other embodiments are within the scope of the following claims.

What is claimed is:

1. A method of moving a workpiece part away from a processing region of a machine tool for processing plate-like workpieces by punching, comprising:

moving a punch and a punching die relative to each other along a stroke axis for punching a workpiece through with the punch to cut the workpiece part free from the workpiece;

while the workpiece is being punched through with the punch, contacting an upper surface of the workpiece with a stripper mounted on a hold-down device of the machine tool;

determining a reference position of the hold-down device along the stroke axis, at which the stripper contacts the upper surface of the workpiece;

after the workpiece is punched through with the punch, positioning the stripper at a particular distance from the reference position above the workpiece according to a rigid motion coupling between a motion of the hold-down device and a motion of the punch such that a position of the hold-down device relative to the punch remains constant while the stripper is lifted from the upper surface of the workpiece, wherein a beginning of the rigid motion coupling between the hold-down device and the punch is detected by comparing positions of the hold-down device and the punch along the stroke axis; and moving the workpiece part that has been cut free from the workpiece with the punch away from the processing region of the machine tool.

2. The method according to claim 1, wherein the particular distance depends on a thickness of the workpiece.

3. The method according to claim 2, wherein the particular distance is at least half of the thickness of the workpiece.

4. The method according to claim 1, wherein the hold-down device is connected to the punch via a pre-tensioning device, which, when in a resting position, positions a lower edge of the punch in a flush alignment with a lower edge of the stripper, and for which the reference position of the hold-down device is detected via a force exerted on a drive unit of the punching tool when the punch contacts the upper surface of the workpiece.

5. The method according to claim 1, wherein the workpiece is a metal sheet.

6. The method according to claim 1, wherein moving the workpiece part comprises pushing the workpiece part.

7. The method according to claim 1, wherein a shoulder of the punch rests against a shoulder of the hold-down device during the rigid motion coupling between the hold-down device and the punch.

* * * * *